United States Patent [19]

Minden

[11] 4,127,764

[45] Nov. 28, 1978

[54] HIGH EFFICIENCY FUSER ROLL ASSEMBLY FOR XEROGRAPHIC MATERIAL

[75] Inventor: Henry T. Minden, Concord, Mass.

[73] Assignee: Sperry Rand Corporation, New York, N.Y.

[21] Appl. No.: 779,438

[22] Filed: Mar. 21, 1977

[51] Int. Cl.[2] ..... H05B 1/00; G03G 15/20

[52] U.S. Cl. ..... 219/216; 219/469; 219/471; 432/60; 432/228

[58] Field of Search ..... 219/216, 469–471, 219/244; 29/129, 116 R, 130, 123; 165/89; 100/93 RP; 38/49, 44, 101, 55, 57, 100; 432/60, 228

[56] References Cited

U.S. PATENT DOCUMENTS

| | | | |
|---|---|---|---|
| 2,875,985 | 3/1959 | Hold | 165/89 |
| 2,958,742 | 11/1960 | Palmer | 165/89 |
| 3,291,460 | 12/1966 | Aser et al. | 219/216 |
| 3,471,683 | 10/1969 | Bogue | 219/469 |

FOREIGN PATENT DOCUMENTS

| | | | |
|---|---|---|---|
| 1,318,133 | 1/1963 | France | 165/89 |

*Primary Examiner*—C. L. Albritton
*Attorney, Agent, or Firm*—Howard P. Terry

[57] ABSTRACT

A high efficiency fuser and pressure roll system for fixing xerographic toner particles to a carrier medium such as paper has an axially located cartridge heater element integrally coupled to a plurality of low thermal mass, high thermal conductivity fins for efficiently transferring heat by direct thermal conduction to and supporting the roll surface. The cartridge heater and fuser roll structure are thermally isolated from the shaft mechanism supporting the fuser roll itself. Quick and efficient heating of the roll surface is afforded, radiative transfer of heat being avoided. Further, there is afforded diminished heat loss through undesired heat conduction into the shaft and associated parts of the copier.

9 Claims, 4 Drawing Figures

HIGH EFFICIENCY FUSER ROLL ASSEMBLY FOR XEROGRAPHIC MATERIAL

BACKGROUND OF THE INVENTION

1. Field of the Invention

The invention generally relates to the field of multiple printing or reproduction apparatus and is more particularly concerned with reproduction apparatus in which an electroscopic toner powder image is heated to an extent sufficient to fuse the powder image onto a web or sheet of a carrier material as it passes through a nip formed between a conductively heated fusing roll and a cooperating back-up pressure roll.

2. Description of the Prior Art

In one form of prior art apparatus for fusing toner powder images to a carrier medium, the medium is fed, after the formation of the toner image, through a separate fuser unit before it passes through cooperating exit rollers. The fuser consists of a parallel array of resistance heater wires supported directly from the copier frame in a heat radiating plane just above the plane of the powder image. Arrangements of this kind are discussed, for example, in the R. F. Pichierri U.S. Pat. No. 3,834,805, issued Sept. 10, 1974 for a "Xerographic Copier with Asynchronous Copy Feed" and assigned to Sperry Rand Corporation.

While the Pichierri apparatus has enjoyed successful use and affords a conveniently low warm-up time for the reproducer, the heater wires, to be relatively efficient, are located close to the plane of the paper or other carrier medium. In the event the paper jams, there is a serious possibility of contact between a hot fuser wire and the paper, even though the hot wires are partially shielded, and fire may result or, at least, there will be damage to the medium.

In a second form of prior apparatus for fusing toner powder images to a carrier medium, the medium is fed, after the formation of the toner image, through cooperating rolls, at least one of the rolls being heated by a non-rotating infrared radiator contained in a cylindrical cavity within the heated roll along its axis of rotation. The radiating device is normally a high power lineal quartz heat lamp or tungsten filament lamp, relatively short-lived and relatively inefficient because of its high operating temperature. Due, among other factors, to its non-rotating axial disposition, transfer of heat to the active cylindrical surface of the fusing roll is entirely by radiation and is therefore inefficient and power consumption is large. Such fuser rolls also have extremely large thermal masses and require an undesirably long warm-up time after operating power is first turned on. Thus, most electrographic plain paper copiers must be left on continuously, even if use is intermittant, with consequent added costs. Heat loss from the fusing roller to other parts of the apparatus is a further serious disadvantage of such prior art roll fuser systems.

SUMMARY OF THE INVENTION

The present invention relates to apparatus for making multiple copies of printed or other matter by xerographic methods, usually on a plain paper carrier medium. The invention is particularly concerned with reproduction apparatus including cooperating toner fuser and pressure roll elements for fixing xerographic particles to a carrier medium. The fuser roll is equipped with an axially located cartridge heater element efficiently coupled integrally or directly to a plurality of low thermal mass, high thermal conductivity radial fins for rapidly transferring heat purely by conduction to the roll surface, in addition to supporting the roll surface with respect to the cartridge heater element so that the heater and the roll surface rotate in unison. The cartridge heater element, its axial support system, and the roll fuser structure are thermally isolated with respect to the shaft-supporting mechanism for rotating the roll. The operating temperature of the heater is reduced and lower operating power is required. Quick and efficient heating of the roll surface is achieved, along with reduced heat loss by thermal conduction into the shaft support mechanism.

DESCRIPTION OF THE PREFERRED EMBODIMENTS

The embodiments of the invention as illustrated in FIGS. 1 through 4 find application, for example, in an automatic xerographic printer or reproduction machine of the type illustrated in the aforementioned Pichierri U.S. Pat. No. 3,834,805. Such machines normally include several xerographic processing stations, beginning with a charging station where a uniform electrostatic charge is deposited on a photoconductive surface. The next station is an exposure station at which a light image is projected onto the photoconductor surface for forming the latent electrostatic image to be reproduced. Following the exposure station is a development station at which developer or toner particles are dispersed over the latent image and, adhering to the charged portions of the latent imge, they form a corresponding powder image. At a transfer station, the powder image is electrostatically transferred intact to a web or sheet of a carrier material such as plain paper which is then passed through a heated fusing system so that the powder image becomes permanently bonded to the surface of the medium. The photoconductor surface is finally passed through a cleaning and illumination station for the removal of all residual toner and charges from the surface so that it may continue to repeat its operational cycle.

Figure 1:
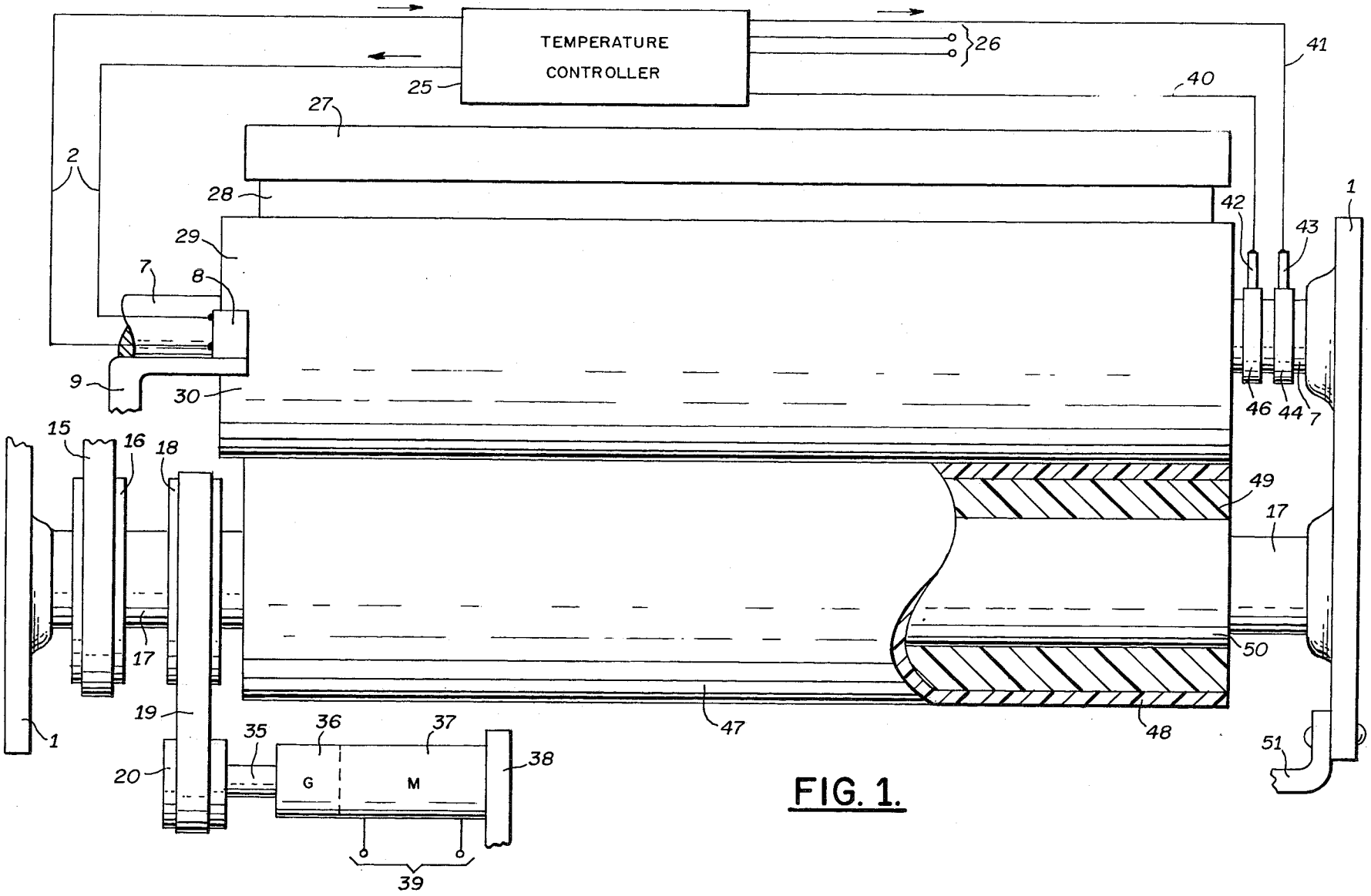
FIG. 1 is an elevation view, partly in cross-section, of a fuser-pressure roll assembly according to the present invention.

Referring particularly to FIG. 1, there is shown a heated pressure toner-fusing system which includes a heated fuser roll 29 and a cooperating back-up pressure roll 47. Details of the heated fuser roll 29 according to the invention will be further discussed in connection with FIGS. 2, 3, and 4. In general, the heated toner-fuser system performs the function of heating the powder image after its electrostatic transfer to the surface of the web or sheet so that the powder fuses and is permanently bonded to the medium upon cooling.

In FIG. 1, the pressure toner-fusing arrangement is supported in a frame or casing 1, which may be common to the remainder of the apparatus. The heated fuser roll 29 is formed on a shaft 7, journalled at its ends in suitable bearings with respect to casing 1. Likewise, pressure roll 47 is formed on a shaft 17 journalled at its ends in suitable bearings with respect to frame or casing 1. By way of example, pressure roll 47 may be driven when power is supplied to terminals 39 by a motor 37 mounted on a bracket 38 supported within casing 1. Motor 37 is equipped with speed-reducing gearing 36, if desired, for driving shaft 35 and pulley 20. The pulley 20 and belt 19 cooperate with a pulley 18 mounted on shaft 17 for driving it in a predetermined direction. Rolls 29 and 47 are under pressure contact during operation, so that rotation of pressure roll 47 necessarily causes fuser roll 29 to rotate in the opposite sense. If desired, fuser roll 29 as well as other moving elements of the apparatus may additionally be rotated by virtue of pulley 16, belt 15, and a cooperating pulley (not shown) fixed on shaft 7. Since the cooperating rolls 29 and 47 are disposed so that there is pressure between them, the flexible material forming outer layer 48 of the back-up pressure roll 47 is desirably distorted, forming a nip of finite width. A conventional mechanism may be provided for separating rolls 29, 47 when not in actual use.

The fuser roll 29 has a specially hated cylindrical surface, as will be seen, that is heated purely by conduction of heat from a central electrical heating element. Controlled heat is applied to provide the proper roll surface temperature for the selected toner. For this purpose, a conventional temperature controller 25 which operates at the desired selected temperature is coupled to a source of power (not shown) at terminals 26. A thermostat 8, which may be a thermistor or other non-contacting thermal sensor, is provided close to the outer surface of the heated fuser roll 29, being supported from bracket 9. Thus, a regulating electrical signal is conveyed via leads 2 to controller 25. The regulated output current of controller 25 is passed by leads 40 and 41 to the respective brushes 42 and 43 and to their associated slip rings 46 and 44. The leads 40 and 41, respectively connected to slip rings 46 and 44, convey the heating current to a cartridge heater element within fuser roll 29, as will be further described in connection with FIG. 2. If desired, thermal sensor 8 may be disposed within fuser roll 29 but close to the outer surface thereof, if additional slip ring-brush combinations are provided.

Pressure roll 47 includes an inner cylinder 49 of an elastomer such as neoprene or silicon rubber bonded to an enlarged portion 50 of cold rolled steel shaft 17 in the conventional manner. Tightly fitting over the hollow cylinder 49 is a relatively thin hollow cylinder 48 composed of a tetrafluoroethylene resin for excluding silicone oil from damaging the material of cylinder 49. Above the heated fuser roll 29 is supported from frame or casing 1 a reservoir 27 of silicone oil or dimethyl polysiloxane, along with conventional wick 28 disposed in contact with the surface of heated fuser roll 29 in a generally conventional manner.

A sheet or web of a copy medium or carrier on which the final image is to be formed, bearing the toner powder image on its upper side, is brought into contact with the nip of the rolls 29, 47 with the powder image contacting the heated fuser roll 29. As the carrier sheet advances between rolls 29, 47, the toner powder image contacts the heated surface of fuser roll 29, whereby the powder image is softened or tackyfied. In this condition, it adheres to the moving web or sheet medium, beng prevented from adhering to the surface of pressure roll 47 due to the nature of the material tetrafluoroethylene resin. The thin film of silicone oil applied by wick 28 to the surface of fuser roll 29 desirably prevents adherence of the tacky toner particles to roll 29 in the usual manner.

Figure 2:
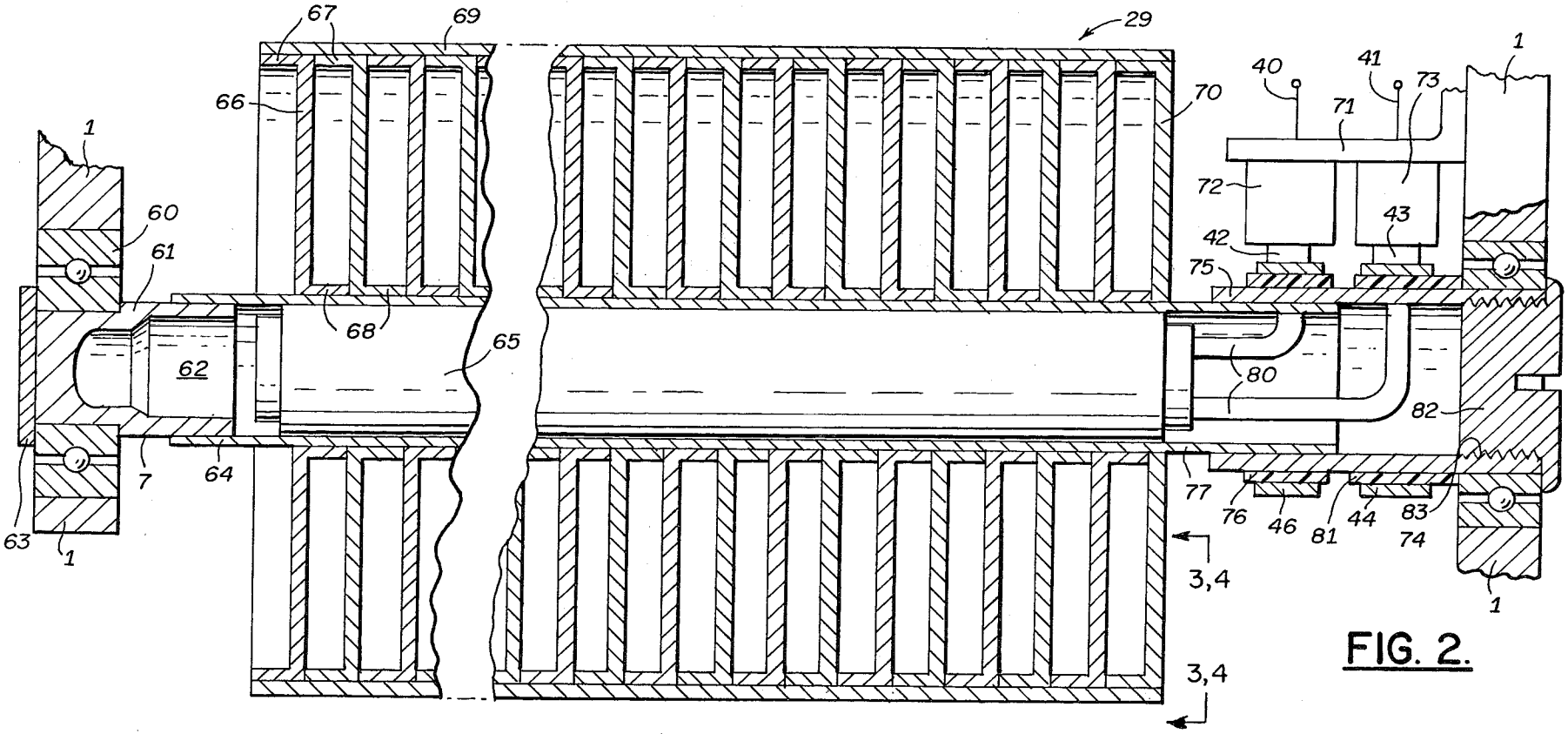
FIG. 2 is an elevation view, mainly in cross-section, of the novel fuser roll employed in the apparatus of FIG. 1.
Figure 4:
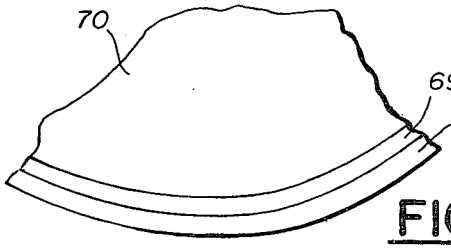
FIGS. 3 and 4 are fragmentary end views taken along the line 3, 4 of FIG. 2 of alternative configurations useful in the fuser roll of FIG. 2.

One preferred form of the novel heat fuser roll 29 is displayed in FIG. 2, where parts common to FIG. 1 bear similar reference numerals. To achieve an effectively low thermal mass with high thermal conductivity, thus permitting rapid heating of the active surface of the fuser roll 29, heat conduction is enhanced substantially only to the roll surface, and loss of heat to the shafts 7 is diminished significantly through the provision of paths having high thermal impedances. As in FIG. 2, the fuser roll 29 is supported in cooperating bearings 60 and 74 at its respective ends, the bearings being journalled in the frame or casing 1 of the copier. At one end of the fuser roll 29, bearing 60 rotatably supports a hollow shaft portion 7 affixed to the inner race of bearing 60 as by plate 63. By virtue of the hollow cavity 62 within shaft 7 and because it is made of a relatively poor heat conductor such as stainless steel, plastic, or the like, an axially-disposed high thermal impedance path results in the general region 61. At a second end of fuser roll 29, bearing 74 supports a hollow tubular shaft portion 75 preferably of the same thermally insulating material as shaft portion 7, tubular shaft portion 75 being internally threaded at 83 so that the end cap 82 serves to affix tube portion 75 to the inner race of bearing 74 for rotation therewith. Again, an axially-disposed, hgih thermal impedance path is formed by shaft portion 75.

Shaft portions 7 and 75 are bonded in a conventional manner to a hollow copper or aluminum tube 77 which extends throughout fuser roll 29, thus forming a complete shaft including portions 7, 77, and 75. Further, tube 77 serves to house a commercially available cartridge heater 65 which fits snugly and securely within the inner surface of tube 77 in intimate contiguous heat-exchanging relation therewith. Cartridge heater 65 preferably extends substantially the full lenght of fuser roll 29, though more than one such heater may be employed. Heater 65 may be a conventional cartridge heater of the kind enclosed in an external brass or other case, with interior nickel-chromium heating elements supported in a refractory body and packed with a refractory powder to conduct heat to the brass case and thence to the shaft tube 77. Asbestos-covered leads 80 are supplied which respectively project through holes (not shown) in insulator bands 76 and 81 that are bonded to the external surface of shaft portion 77. Insulator bands 76 and 81 respectively support slip rings 46 and 44 which cooperate with the respective brushes 42 and 43 connected respectively to leads 40, 41 of FIG. 1. Brushes 42, 43 may be supported in a conventional manner in brush holders 72, 73 from a bracket 71 of the copier frame or case 1.

Rapid and efficient flow of heat from the internal thin-walled shaft portion 77 into the thin-walled hollow cylinder 69 forming the active surface of the fuser roll 29 is desired. For this purpose, the surface of cylinder 69 is supported by an array of copper or aluminum fins, such as fin 66. Each fin is equipped, like fin 66, with opposed flanges 67, 68, flanges 67 being affixed, as by brazing, to the interior surface of cylinder 69, while flanges 68 are similarly affixed to the external surface of the hollow shaft portion 77. Wall thicknesses of shaft portion 77, fins 66, and surface cylinder 69 are, for example, 0.030 inches and fins 66 may be placed 0.16 to 0.25 inches apart. In this manner, the fuser roll 29 has a desirably low mechanical inertia and a low thermal mass, efficient conduction of heat to the fuser roll surface 69 is promoted, and loss of ehat through the shaft end portions 7, 77 is reduced. With a 1000 watt cartridge heater 65, a temperature of 250° F. at the surface of outer cylinder 69 may readily be achieved in about ten seconds.

Figure 3:
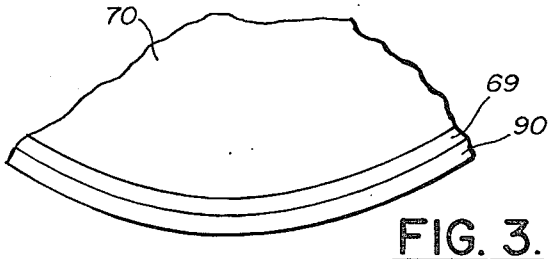

In FIG. 3, the surface of the copper or aluminum cylinder 69 is plated with a thin layer 90 of chromium to aid prevention of adherence of tacky toner in cooperation with a thin layer of silicone oil applied by wick 28. Alternatively, at in FIG. 4, a layer 91 of a plastic or resin material such as a tetrafluoroethylene resin may be applied to copper or aluminum layer 91.

Accordingly, it is seen that the invention provides efficient conductively heated fuser-pressure roll assemblies having low effective thermal masses and low heat loss to associated parts of a xerographic reproduction machine, thereby permitting rapid heating of the surface of the fuser roll. More efficient operation is provided by the use of direct thermal conduction from the heater, integral with the roller, to the toner material, radiative heat transfer being avoided. In viewing the several figures, it will be understood by those skilled in the art that liberties have been taken in the selection of proportions and dimensions of various elements in the interest of providing clarity in the drawings, and that the exact proportions and dimensions illustrated would not necessarily be selected for use by those skilled in practicing the art. Those skilled in the art will also understand that the invention may be used in a wide range of applications wherein the selected operating parameters, such as the fuser roll surface temperature, roll speed, roll pressure, and such variables will depend upon the character the selected toner and web or sheet carrier characteristics.

While the invention has been described in its preferred embodiments, it is to be understood that the words which have been used are words of description rather than of limitation and that changes within the purview of the appended claims may be made without departing from the true scope and spirit of the invention in its broader aspects.

I claim:

1. An efficient fuser roll assemnbly for use in a xerographic copier including:

frame means, shaft means, bearing means for journalling said shaft means at opposite ends thereof within said frame means, said shaft means having a hollow central thermally conductive portion and having an inner and an outer wall, said shaft means additionally having end portions of thermal conductivity much lower than the thermal conductivity of said hollow central portion, heater means in intimate contiguous heat exchanging contact with said inner wall within said hollow central portion, an array of spaced, radially extending, thermally conductivity fins affixed to said outer wall, each said fin having an outer peripheral portion, and hollow cylindrical tube means surrounding said array of fins in intimate conductive heat exchanging relation at said outer peripheral portions of said fins, whereby heat is efficiently propagated by direct conduction from said heater means to said hollow cylindrical tube means and flow of heat through said bearing means in inhibited.

2. Apparatus as described in claim 1 wherein:

at least one of said end portions of said shaft means is hollow and has an outer surface, slip ring means supported in electrically insulated relation on said outer surface, electrical conductor means extending in electrically insulated relation through said end portion for coupling said slip rings to said heater means, brush means in electrically conductive contact with said slip ring means and supported from said frame means, and circuit means for supplying regulated electrical heating current to said electrically conductive brush means.

3. Apparatus as described in claim 1 wherein said heater means comprises cylindrical cartridge heater means.

4. Apparatus as described in claim 1 wherein said end portions of said shaft means are composed of stainless steel.

5. Apparatus as described in claim 1 wherein said hollow central portion of said shaft means, said fins, and said hollow cylindrical tube are composed of a metal from the class including copper and aluminum.

6. Apparatus as described in claim 5 wherein said fins are substantially 0.030 inches thick.

7. Apparatus as described in claim 1 wherein said hollow cylindrical tube means has an outer surface, said outer surface being coated with a layer of chromium.

8. Apparatus as described in claim 1 wherein said hollow cylindrical tube means has an outer surface, said outer surface being coated with a layer of a tetrafluoroethylene resin.

9. Apparatus as described in claim 1 additionally including:

pressure roll means journalled for rotation within said frome means in parallel relation with said fuser roll shaft means for forming a nip between said pressure roll means and said hollow cylindrical tube means, said pressure roll means comprising:

pressure roll shaft means journalled for rotation in said frame means, a tubular layer of an elastomer bonded to said roll shaft means, and a thin layer of tetrafluoroethylene resin bonded to said elastomer tubular layer.

* * * * *